US005794931A

United States Patent [19]

Heilman et al.

[11] Patent Number: 5,794,931

[45] Date of Patent: Aug. 18, 1998

[54] GUIDE APPARATUS AND METHOD FOR SELECTIVELY GUIDING SHEETS INTO A PREDETERMINED PATH

[75] Inventors: Robin L. Heilman, Willow Springs; Joseph G. Melber, Jr., Apex, both of N.C.

[73] Assignee: Bell & Howell Mail Processing Systems, Durham, N.C.

[21] Appl. No.: 771,586

[22] Filed: Dec. 20, 1996

[51] Int. Cl.[6] ..... B65H 39/10

[52] U.S. Cl. ..... 271/303; 271/184; 271/225

[58] Field of Search ..... 271/303, 184, 271/225

[56] References Cited

U.S. PATENT DOCUMENTS

| | | | |
|---|---|---|---|
| 4,785,942 | 11/1988 | Leijenhorst et al. | 271/303 |
| 4,986,529 | 1/1991 | Agarwal et al. | 271/303 |
| 5,131,644 | 7/1992 | DuBois | 271/303 |
| 5,603,494 | 2/1997 | Baker et al. | 271/303 |

FOREIGN PATENT DOCUMENTS

| | | | |
|---|---|---|---|
| 204953 | 8/1959 | Austria | 271/303 |
| 172172 | 7/1989 | Japan | 271/303 |

*Primary Examiner*—Joseph E. Valenza
*Assistant Examiner*—Khoi H. Tran
*Attorney, Agent, or Firm*—Jenkins & Wilson, P.A.

[57] ABSTRACT

A guide apparatus and method are provided for selectively guiding sheet articles into a first, second or third conveying path. In a preferred embodiment, the first and second conveying paths are the upper and lower conveying paths, respectively, of a dual-deck accumulator and the third conveying path is a divert path. The guide apparatus includes a guide member having a pair of spaced-apart divert plates which are elongated and parallel so as to define a slot therebetween for passage of sheet articles therethrough. The divert plates are fixedly positioned with respect to one another and selectively pivotal in a first position for guiding sheet articles into a first conveying path, a second position for guiding sheet articles into a second conveying path and a third position for guiding sheet articles into a third conveying path.

15 Claims, 5 Drawing Sheets

GUIDE APPARATUS AND METHOD FOR SELECTIVELY GUIDING SHEETS INTO A PREDETERMINED PATH

TECHNICAL FIELD

The present invention relates generally to apparatuses and methods for selectively guiding sheet articles, and more particularly, to an apparatus and method for selectively guiding sheet articles into one of a plurality of predetermined conveying paths or diverting sheet articles from advancing through either of the conveying paths.

BACKGROUND ART

Belt-driven accumulators for accumulating sheet articles such as sheets of paper utilized in mail processing are well-known for accumulating sheets fed in a seriatim stream thereto in accumulated stacks or sets of sheets. Accumulators of this type typically include at least two driven belts which engage a sheet at its upper and lower surfaces, respectively, shaft-mounted pulleys for directing and driving the belts, side guides which engage and guide the edges of sheets being transported by the belts, one or more ramps for directing advancing sheets upwardly or downwardly to over-accumulate or under-accumulate, respectively, the sheets in a stack, and a mechanism for preventing the stacked sheets from being fed by the belts out of the accumulator until all sheets for a particular set have been accumulated.

Stacking of such sheet accumulators is also common to form what is commonly referred to as a "dual-deck accumulator" wherein the dual-deck accumulator therefore understandably has an upper conveying path and a lower conveying path for advancement and accumulation of sheet articles through the upper accumulator and the lower accumulator, respectively, of the dual-deck accumulator. To selectively guide sheets advanced to a dual-deck accumulator, it has been common in the past to utilize a divert gate which consists of a pivotally movable, elongated divert plate positioned upstream of a dual-deck accumulator. The single divert gate is selectively movable only to deflect advancing sheets slightly upwardly to guide the sheets into the upper conveying path of the dual-deck accumulator or to deflect advancing sheets slightly downwardly to guide the sheets into the lower conveying path of the dual-deck accumulator.

In view of the prior art divert gate for selectively guiding sheets into a dual-deck accumulator as described hereinabove, there remains much room for improvement in the art for a novel guide apparatus for selectively guiding sheets into a first, second or third conveying path, such as for guiding sheet articles into one of the conveying paths of a dual-deck accumulator or into a divert path to divert and prevent the sheets from advancing into either of the conveying paths of a dual-deck accumulator.

SUMMARY OF THE INVENTION

In accordance with the present invention, a novel guide apparatus and method are provided for selectively guiding sheet articles into a first, second or third conveying path. In a preferred embodiment, the first and second conveying paths are the upper and lower conveying paths, respectively, of a dual-deck accumulator, and the third conveying path is a divert path for diverting sheet articles from advancing through either of the upper or lower conveying paths.

The guide apparatus comprises a guide member positioned upstream of a first and second conveying path, such as the upper and lower conveying paths of a dual-deck accumulator. In a preferred embodiment, the guide member comprises a pair of spaced-apart divert plates which are elongated and parallel so as to define a slot therebetween for passage of sheet articles therethrough. The divert plates are fixedly positioned with respect to one another and selectively pivotal in a first position for guiding sheet articles into the first conveying path, a second position for guiding sheet articles into the second conveying path and a third position for guiding sheet articles into a third conveying path, which can, for example, be a divert path for diverting sheet articles to prevent the sheet articles from advancing into either of the first or second conveying paths.

It is therefore an object of the present invention to provide a novel guide apparatus and method for selectively guiding sheet articles into a first, second or third conveying path, such as the upper or lower conveying paths of a dual-deck accumulator or a divert path for diverting sheet articles from advancing into either of the upper or lower conveying paths.

It is another object of the present invention to provide a guide apparatus and method for selectively guiding sheet articles into a dual-deck accumulator or diverting sheet articles from advancing into the dual-deck wherein the guide apparatus and method are operable for guiding sheet articles processed at high speeds.

Some of the objects of the invention having been stated hereinabove, other objects will become evident as the description proceeds, when taken in connection with the accompanying drawings as best described hereinbelow.

DETAILED DESCRIPTION OF THE INVENTION

Figure 1:
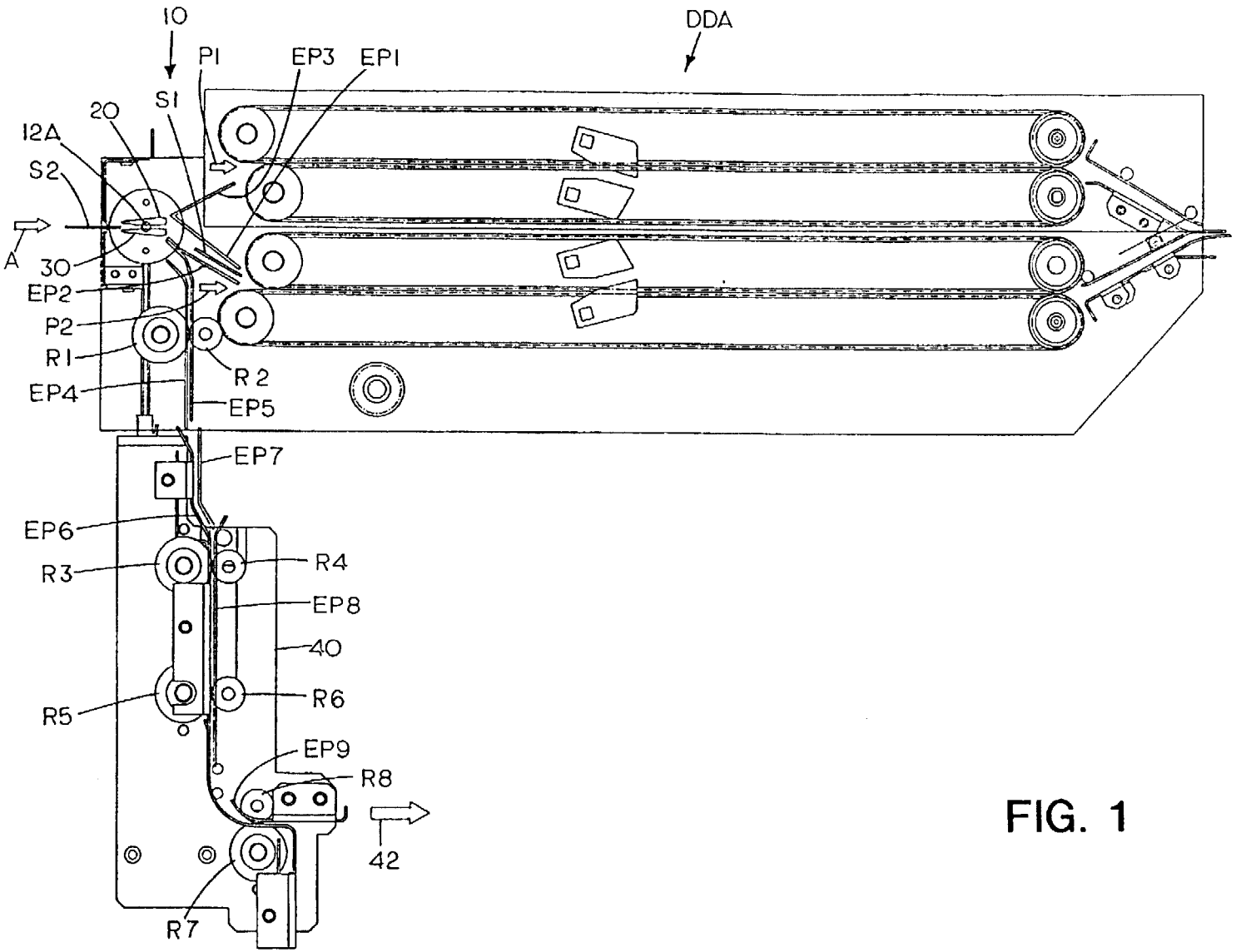
FIG. 1 of the drawings is a side view of a preferred embodiment of the guide apparatus according to the present invention positioned upstream of a dual-deck accumulator with the guide apparatus adapted for guiding sheet articles into the lower conveying path of the dual-deck accumulator.
Figure 2:
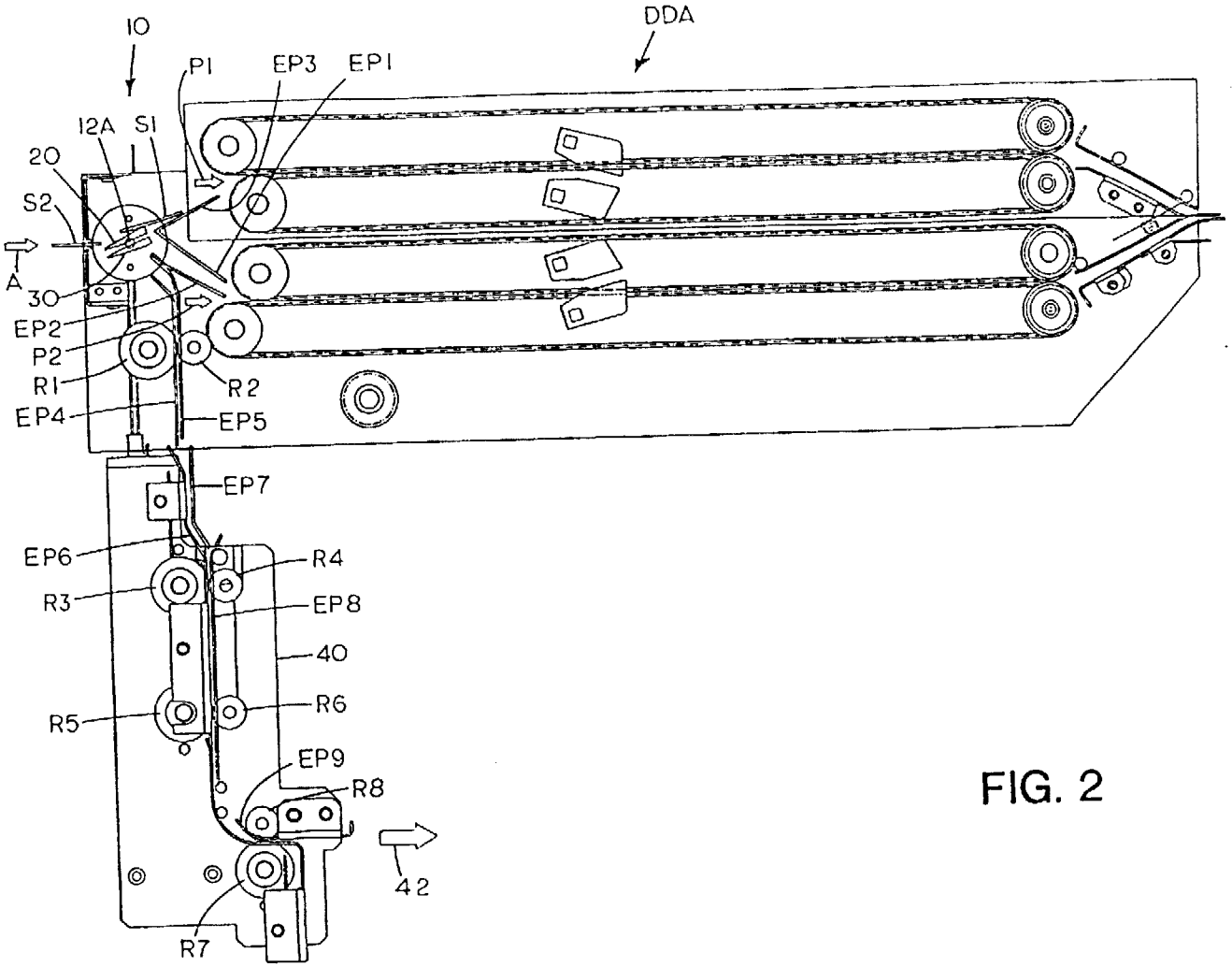
FIG. 2 of the drawings is a side view of the guide apparatus and dual-deck accumulator shown in FIG. 1 with the guide apparatus adapted for guiding sheet articles into the upper conveying path of the dual-deck accumulator.
Figure 3:
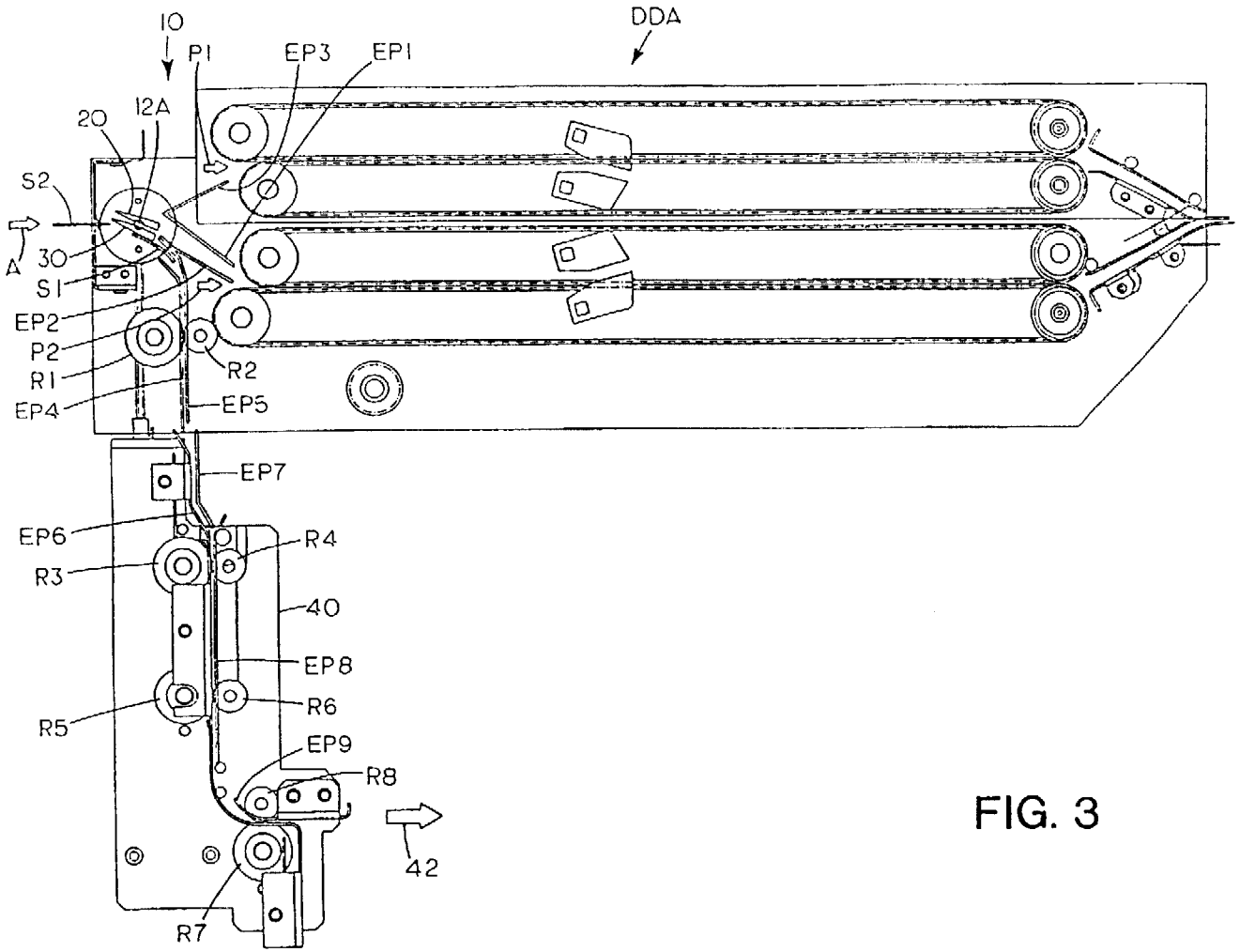
FIG. 3 of the drawings is a side view of the guide apparatus and dual-deck accumulator of FIG. 1 with the guide apparatus adapted for guiding sheet articles into a divert path to prevent the sheet articles from advancing into either of the upper or lower conveying paths of the dual-deck accumulator.

In accordance with the present invention, a novel guide apparatus generally designated 10 and method are provided for selectively guiding sheet articles into a first, second or third conveying path for sheet articles. In a preferred embodiment, the first and second conveying paths are the upper and lower conveying paths, respectively, of a dual-deck accumulator, and the third conveying path is a divert path for diverting sheet articles from advancing through either of the upper or lower conveying paths. Referring to FIGS. 1, 2 and 3 of the drawings, guide apparatus 10 is particularly suitable for positioning upstream of a dual-deck accumulator generally designated DDA having an upper accumulator deck and a lower accumulator deck as is readily understood by those of skill in the art of sheet processing. Dual-deck accumulator DDA therefore includes a first or upper conveying path generally designated by arrow P1 which extends between the upper and lower belts of the upper accumulator deck, and a second or lower conveying path generally designated by arrow P2 which extends between the upper and lower conveying belts of the lower accumulator deck of dual-deck accumulator DDA. While guide apparatus 10 as shown extends between extended side walls dual-deck accumulator DDA and can therefore be integrally included with dual-deck accumulator DDA such that guide apparatus 10 and dual-deck accumulator DDA form one modular unit, it is envisioned according to this invention that guide apparatus 10 could be attached as a separate unit to and properly positioned in front of dual-deck accumulator DDA.

Figure 4:
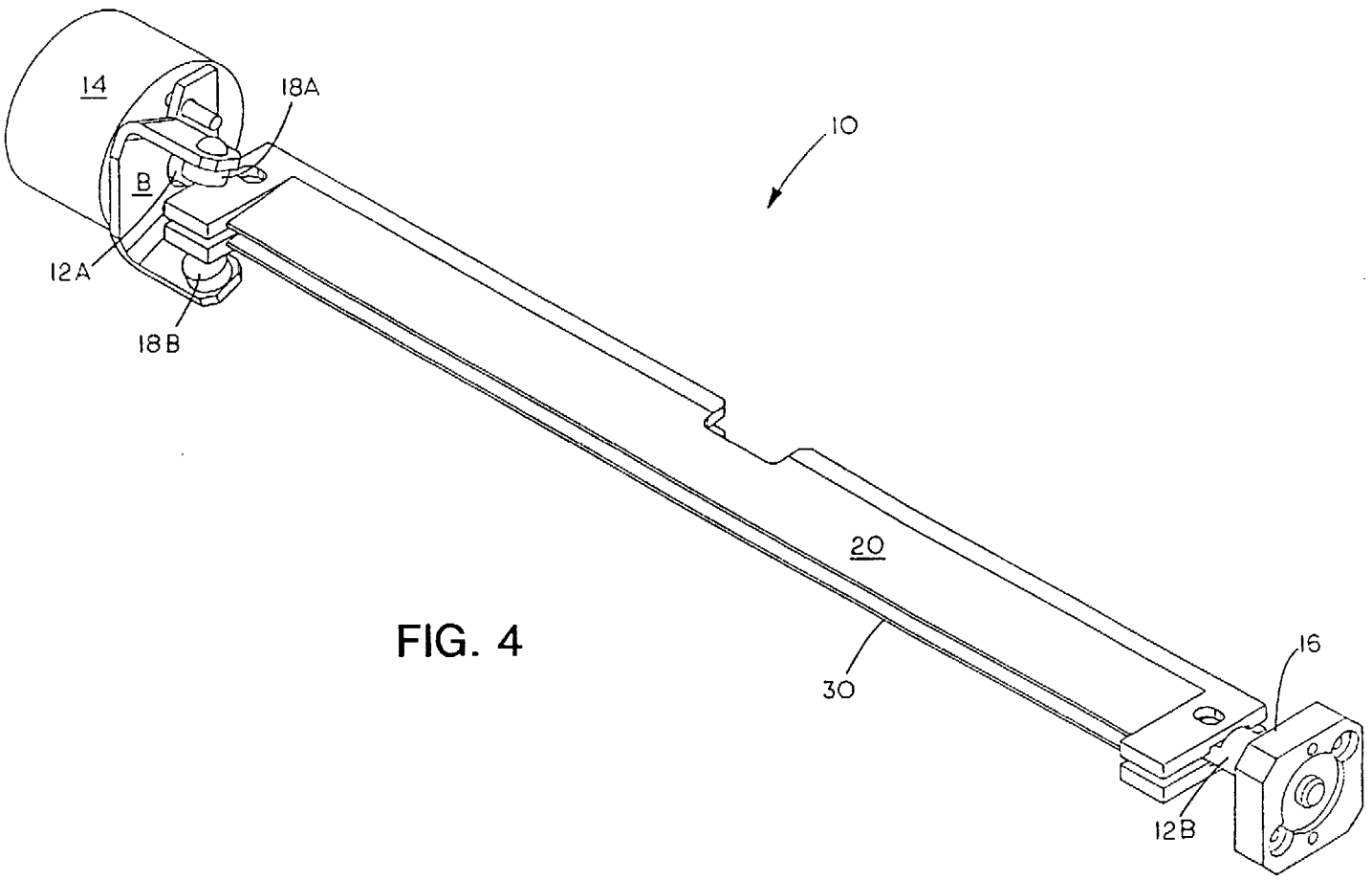
FIG. 4 of the drawings is an isolated perspective view of a portion of the guide apparatus according to the present invention.
Figure 5:
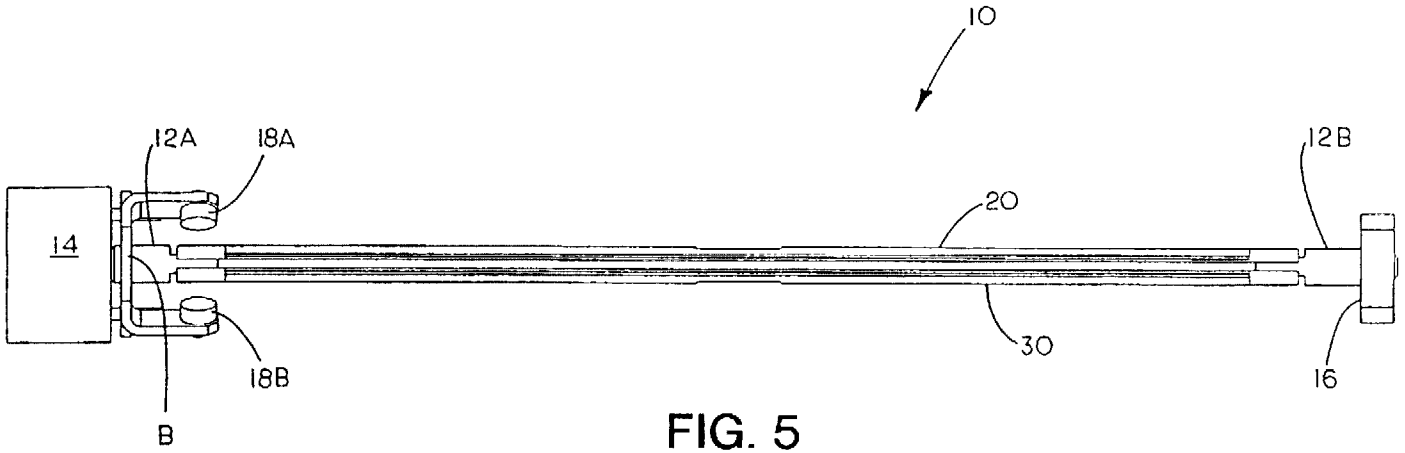
FIG. 5 of the drawings is a front view of the portion of the guide apparatus shown in FIG. 4.

As best illustrated in FIGS. 4 and 5 of the drawings, guide apparatus 10 comprises a pair of first and second divert plates 20 and 30, respectively, which are fixedly positioned with respect to one another in a spaced-apart and parallel manner so as to define a slot or passage therebetween for passage of sheet articles therethrough. First and second divert plates 20 and 30, respectively, are preferably suitably thin and straight and are adapted to extend laterally at least substantially as far as upper and lower conveying paths P1 and P2 of dual-deck accumulator DDA (FIGS. 1 through 3). First and second divert plates 20 and 30, respectively, can be constructed of any suitable material such as, for example, a metal or plastic material. First and second divert plates 20 and 30, respectively, preferably tapered toward one end thereof to facilitate operative advancement of sheet articles past first and second divert plates 20 and 30, respectively. Opposing ends of first and second divert plates 20 and 30, respectively, are fixedly attached to shafts 12A and 12B, respectively. Shaft 12A extends from and operatively connects to solenoid 14 at an end of shaft 12A opposite first and second divert plates 20 and 30, respectively, and shaft 12B is rotatably attached to block 16 at an end of shaft 12B opposite first and second divert plates 20 and 30, respectively. Solenoid 14 can thereby be actuated to selectively rotate shaft 12A which simultaneously therefore rotates or pivots first and second divert plates 20 and 30, respectively, and shaft 12B whereby first and second divert plates 20 and 30, respectively, can pivot about a center longitudinal axis defined by shafts 12A and 12B. A suitably designed bracket B with stop pads 18A and 18B on opposing ends thereof is positioned at one end of first and second divert plates 20 and 30, respectively, wherein a portion of first and second divert plates 20 and 30, respectively, extend therebetween such that stop pads 18A and 18B can provide a stop for rotational movement of first and second divert plates 20 and 30, respectively, to suitably limit the range of rotational or pivotal movement of first and second divert plates 20 and 30, respectively.

Referring again now to FIGS. 1 through 3 of the drawings, sheet articles can be advanced in the direction generally designated by arrow A to guide apparatus 10 which is suitably positioned upstream of dual-deck accumulator DDA. As shown in FIGS. 1–3, guide apparatus 10 is positioned upstream of dual-deck accumulator DDA with first and second divert plates 20 and 30, respectively, positioned in front of dual-deck accumulator DDA substantially in a plane extending between the upper and lower accumulators of dual-deck accumulator DDA. Sheet articles can be advanced to first and second divert plates 20 and 30, respectively, of guide apparatus 10 for the advancing sheet articles to be selectively guided into upper conveying path P1 or lower conveying path P2 of dual-deck accumulator DDA or into a divert path to divert the sheet articles and prevent them from passing into either upper conveying path P1 or lower conveying path P2 of dual-deck accumulator DDA, as described further hereinbelow.

Referring specifically to FIG. 1 of the drawings, first and second divert plates 20 and 30, respectively, of guide apparatus 10 are in a neutral position adapted for guiding advancing sheet articles into lower conveying path P2 of dual-deck accumulator DDA. In this neutral position, advancing sheet articles such as sheet S1 and sheet S2 can pass completely between first and second divert plates 20 and 30, respectively, and be guided by extension plates EP1 and EP2 to lower conveying path P2 of dual-deck accumulator DDA. As shown in FIG. 1, sheet S1 has already passed between first and second divert plates 20 and 30, respectively, and is positioned between extension plates EP1 and EP2 so as to be guided into lower conveying path P2 of dual-deck accumulator DDA. Sheet S2 is following sheet S1 and has just begun to pass between first and second divert plates 20 and 30, respectively, to ultimately be guided into lower conveying path P2.

Referring now specifically to FIG. 2 of the drawings, first and second divert plates 20 and 30, respectively, of guide apparatus 10 are in a position adapted for guiding advancing sheet articles into upper conveying path P1 of dual-deck accumulator DDA. First and second divert plates 20 and 30, respectively, are angled slightly upwardly such that advancing sheet articles are deflected by the outer side of first divert plate 20 and onto extension plate EP3 to be guided into upper conveying path P1 of dual-deck accumulator DDA. As shown in FIG. 2, a first advancing sheet, sheet S1, has been deflected slightly upwardly by first divert plate 20 and is advancing on and across extension plate EP3 to be guided into upper conveying path P1 of dual-deck accumulator DDA. A second advancing sheet article, sheet S2 is following sheet S1 and is about to be deflected by first divert plate 20 to be guided onto extension plate EP3 and into upper conveying path P1.

Referring now specifically to FIG. 3 of the drawings, first and second divert plates 20 and 30, respectively, of guide apparatus 10 are in a position adapted for guiding advancing sheet articles into a third divert path to prevent the sheet articles from advancing into either upper conveying path P1 or lower conveying path P2 of dual-deck accumulator DDA. In this position, first and second divert plates 20 and 30, respectively, are angled slightly downwardly such that the outer side of second divert plate 30 can deflect advancing sheet articles into the divert path defined by and between extension plates EP4 and EP5. As shown in FIG. 3, a first advancing sheet article, sheet S1, has been deflected by the outer side of second divert plate 30 into the path extending between extension plates EP4 and EP5. A second advancing sheet article, sheet S2, is following sheet S1 and is about to be deflected by second divert plate 30 to the divert path defined between extension plates EP4 and EP5. One or more pairs of rollers, such as, for example, pair of rollers R1 and R2 can be appropriately utilized to facilitate advancement of diverted sheet articles through the divert path defined between extension plates EP4 and EP5.

The divert path through which sheet articles can be advanced can comprise any suitable path adapted for advancing sheet articles. As shown in FIGS. 1 through 3 of the drawings in a preferred embodiment, the divert path according to the present invention comprises a detachable paper transport assembly 40 positioned below divert plates 20 and 30. Paper transport assembly 40 provides an extension of the divert path and comprises extension plates EP6 and EP7 adapted to receive sheet articles therebetween advancing from between extension plates EP4 and EP5. Extension plate EP8 is utilized below extension plate EP7 and extension plate EP9 is utilized operatively below extension plate EP8 such that sheet articles can be guided between extension plates EP6 and EP7 upon entrance into assembly 40, then between extension plates EP6 and EP8 midway through assembly 40, and then between extension plates EP6 and EP9 to exit assembly 40. One or more pairs of rollers can understandably be utilized to facilitate advancement of sheet articles through the divert path defined through assembly 40. For example, rollers R3 and R4 and then rollers R5 and R6 can advance sheet articles between extension plates EP6 and EP8, and rollers R7 and R8 can advance sheet articles between extension plates EP6 and EP9. Sheet articles exiting assembly 40 from between extension plates EP6 and EP9 therefore exit in the direction indicated by arrow 42.

While guide apparatus 10 can be used for guiding sheet articles into either of the conveying paths of a dual-deck accumulator or into a divert path as described hereinabove, it can be readily appreciated that guide apparatus 10 can be used to guide and direct sheet articles into any three suitable conveying paths which can be conveying paths other than those of a dual-deck accumulator and can be conveying paths where no divert action occurs.

It is therefore seen that the present invention provides a novel guide apparatus and method for selectively guiding sheet articles into a first, second or third conveying path, such as the upper or lower conveying paths of a dual-deck accumulator or a divert path for diverting sheet articles from advancing into either of the upper or lower conveying paths. It is also seen that the present invention provides a guide apparatus and method for selectively guiding sheet articles into a dual-deck accumulator or diverting sheet articles from advancing into the dual-deck wherein the guide apparatus and method are operable for guiding sheet articles processed at high speeds.

It will be understood that various details of the invention may be changed without departing from the scope of the invention. Furthermore, the foregoing description is for the purpose of illustration only, and not for the purpose of limitation as the invention is defined by the following, appended claims.

What is claimed is:

1. A guide apparatus for selectively guiding sheets into a first, second or third conveying path, said apparatus comprising:

(a) a guide member comprising at least a pair of spaced-apart divert plates maintained parallel with respect to one another, said divert plates being selectively pivotal in at least a first position for guiding sheets into a first conveying path by deflection of sheets with an outer side of one of said divert plates, a second position for guiding sheets into a second conveying path by passage of sheets between said divert: plates, and a third position for conveying sheets into a third conveying path by deflection of sheets with an outer side of another of said divert plates; and (b) a movement mechanism for selectively and simultaneously positioning said divert plates into said at least first, second and third positions;

(c) whereby sheets advanced to said guide member can be selectively guided into the first, second or third conveying paths by selective positioning of said guide member by said movement mechanism.

2. The apparatus of claim 1 wherein said divert plates are elongate and substantially parallel whereby said divert plates define a slot therebetween for advancement of sheets therethrough.

3. The apparatus of claim 2 wherein said divert plates are tapered at one end thereof.

4. The apparatus of claim 1 wherein at least said first and second conveying paths are an upper and lower conveying path, respectively, of a dual-deck accumulator and said third conveying path is a divert path to prevent the sheets from advancing into either of the first or second conveying paths.

5. The apparatus of claim 1 wherein said movement mechanism comprises at least one solenoid operatively attached to said guide member.

6. The apparatus of claim 1 further comprising a plurality of extension plates, positioned between said divert plates and the first, second and third conveying paths for guiding sheets into the first, second or third conveying paths.

7. The apparatus of claim 6 further comprising at least one pair of rollers for advancing sheets along at least one of the first, second or third conveying paths.

8. A method of selectively guiding sheets into at least a first, second or third conveying path, said method comprising the steps of:

(a) advancing one or more sheets to a guide member comprising at least a pair of spaced-apart divert plates maintained parallel with respect to one another; and (b) selectively guiding the advanced sheets with said guide members into a first conveying path by simultaneously positioning said divert plates to deflect the sheets with an outer side of one of said divert plates into the first conveying path, into a second conveying path, by simultaneously positioning said divert plates such that the sheets advance between said divert plates to the second conveying path, or into a third conveying path by simultaneously positioning said divert plates to deflect the sheets with an outer side of another of said divert plates into the third conveying path.

9. The method of claim 8 wherein said divert plates are selectively positioned utilizing at least one solenoid.

10. The method of claim 8 wherein said sheets are advanced on an extension plate after advancing past said guide member to be guided into either of the first, second or third conveying paths.

11. The method of claim 8 wherein the first and second conveying paths are the upper and lower conveying paths, respectively, of a dual-deck accumulator and the third conveying path is a divert path, and wherein sheets are selectively guided into either the upper conveying path, the lower conveying path, or the divert path to divert and prevent the sheets from advancing into either of the upper or lower conveying paths.

12. The method of claim 11 wherein said sheets are advanced on or between one or more extension plates after advancing past said guide member to be guided into either of the upper, lower or divert conveying paths.

13. The method of claim 8 wherein sheets are fed seriatim to said guide member.

14. A method of selectively guiding sheets into an upper or lower conveying path of a dual-deck accumulator or into a divert path to prevent the sheets from advancing into either of the upper or lower conveying paths of the dual-deck accumulator, said method comprising the steps of:

(a) advancing one or more sheets to a guide member positioned upstream of a dual-deck accumulator having an upper and lower conveying path, said guide member comprising a pair of first and second spaced-apart divert plates maintained parallel with respect to one another; and (b) selectively guiding the advanced sheets with said guide member into the upper conveying path or the lower conveying path or into a divert path to prevent the sheets from advancing into either of the upper or lower conveying paths, wherein said divert plates move, simultaneously and wherein the advanced sheets are guided into the upper conveying path by an outer side of said first divert plate deflecting the sheets thereinto, the advanced sheets are guided into the lower conveying path by the sheets passing between said first and second divert plates, and the advanced sheets are guided into the divert path by an outer side of said second divert plate deflecting the sheets thereinto.

15. A method of selectively guiding sheets into at least a first, second or third conveying path, said method comprising the steps of:

(a) advancing one or more sheets to a guide member comprising at least a pair of spaced-apart divert plates which are fixedly positioned with respect to one another; and (b) selectively guiding the advanced sheets with said guide members into a first conveying path by simultaneously positioning said divert plates to deflect the sheets with an outer side of one of said divert plates into the first conveying path, into a second conveying path by simultaneously positioning said divert plates such that the sheets advance between said divert plates to the second conveying path, or into a third conveying path by simultaneously positioning said divert plates to deflect the sheets with an outer side of another of said divert plates into the third conveying path.

* * * * *